US005389014A

United States Patent [19]

Kümpel et al.

[11] Patent Number: 5,389,014

[45] Date of Patent: Feb. 14, 1995

[54] ELECTRICAL CONNECTOR HAVING SECONDARY LOCKING MECHANISM

[75] Inventors: Dietrich W. Kümpel, Rüsselsheim; Rolf Jetter, Darmstadt, both of Germany

[73] Assignee: The Whitaker Corporation, Wilmington, Del.

[21] Appl. No.: 102,164

[22] Filed: Aug. 4, 1993

[30] Foreign Application Priority Data

Aug. 11, 1992 [GB] United Kingdom ..... 9216994

[51] Int. Cl.[6] ..... H01R 13/436

[52] U.S. Cl. ..... 439/752; 439/595

[58] Field of Search ..... 439/752, 595

[56] References Cited

U.S. PATENT DOCUMENTS 4,698,030 10/1987 Ryll et al. ..... 439/752
4,767,361 8/1988 Hoshino et al. ..... 439/596
5,076,806 12/1991 Hotea et al. ..... 439/595
5,299,959 4/1994 Yamamoto et al. ..... 439/752

*Primary Examiner*—Eugene F. Desmond
*Attorney, Agent, or Firm*—Eric J. Groen; Adrian J. LaRue

[57] ABSTRACT

An electrical connector includes passageways for receiving electrical terminal contacts. The electrical terminals are primarily locked in their cavities by way of locking lances on electrical terminals engaging with locking shoulders in respective passageways. The electrical terminals are secondarily locked in their passageways by way of a locking member which has first and second latching elements positioned along straps, the latching elements providing a first latching position on rails and the second elements providing a second fully locked position. The locking member is axially slidable rearwardly to a position where locking members are positioned above respective openings and the secondary lock member can be pushed downwardly such that the locking members are positioned behind the electrical terminals for secondary locking.

13 Claims, 5 Drawing Sheets

ELECTRICAL CONNECTOR HAVING SECONDARY LOCKING MECHANISM

FIELD OF THE INVENTION

The subject connector relates to an electrical connector housing having a secondary locking mechanism for reassuring the contact retention within the housing.

DESCRIPTION OF THE PRIOR ART

An electrical connector of this type is shown in European Patent Application 0 424 887 whereby a secondary locking mechanism is connected to the main housing body by way of a web of plastic material forming a hinge which allows the secondary locking mechanism to rotate into place. While the secondary locking mechanism of the referenced European Application works well once snapped into place, the secondary lock can be cumbersome when the secondary lock is in the open position, as it may become snagged on the wiring forming cable harnesses and could possibly be broken off. Furthermore, the housing must be molded from a relatively soft plastic, allowing the hinge to flex. It is desirable, however to have housings molded from a harder, glass-filled material, to increase retention forces.

SUMMARY OF THE INVENTION

An object of the invention then, is to provide a secondary locking mechanism for a connector housing which can not be snagged on wiring, or be broken off, yet which exhibits the high secondary locking capabilities.

The objects of the invention were accomplished by providing an electrical connector of the type comprising an insulating housing body and at least one passageway for receiving an electrical terminal, and a locking member for positively retaining said terminal in said one passageway. Said housing body has at least one transverse channel in communication with said one passageway where said locking member is moveable transversely of said terminal into said one transverse channel where said locking member can be positioned behind a locking shoulder of said one terminal. Said connector being characterized in that said locking member is captively supported by said housing body, and said locking member is moveable longitudinally of said housing body from a first position where said terminals can be inserted, to a second position where said locking member is in communication with said transverse passageway for locking said terminal. Said locking member is in communication with said transverse passageway for locking said terminal, said locking member being movable transversely into said transverse channel to retain said one terminal.

DETAILED DESCRIPTION OF THE PREFERRED EMBODIMENT

Figure 1:
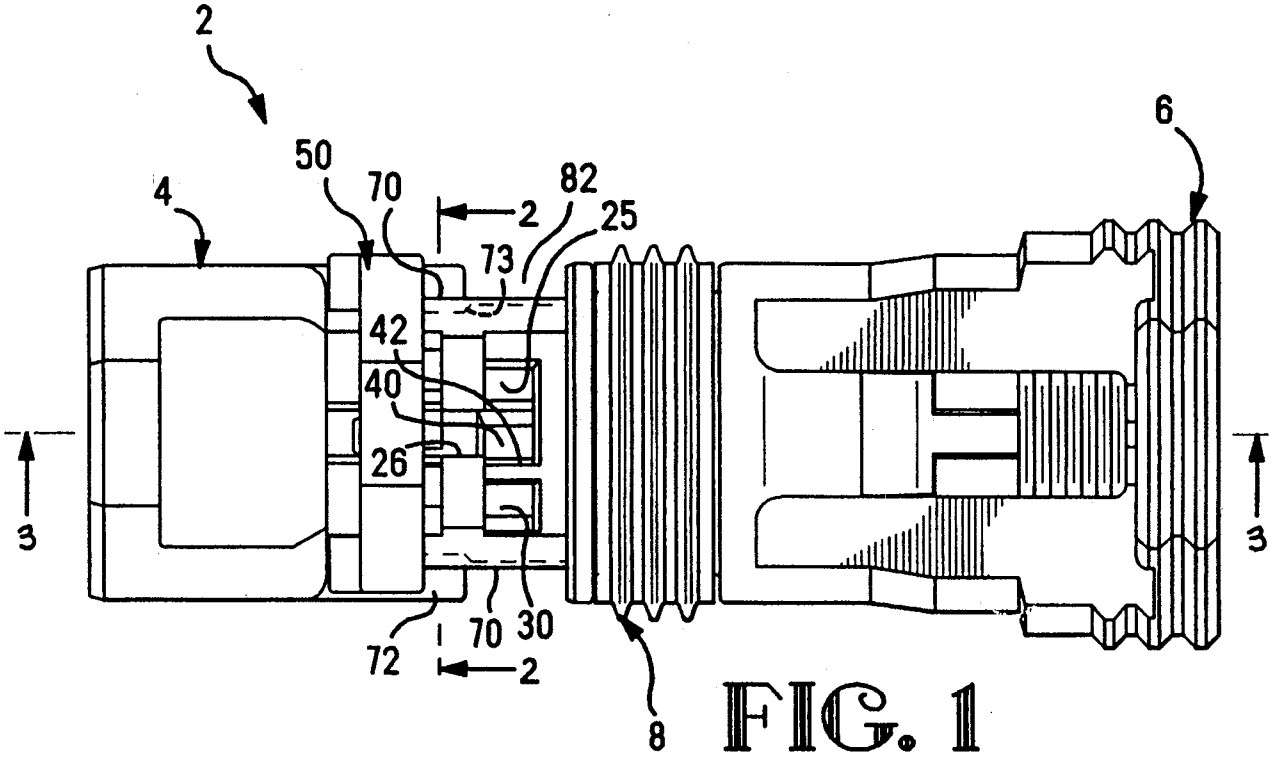
FIG. 1 is a top plan view of the subject electrical connector showing the secondary locking mechanism in its fully open position.
Figure 4:
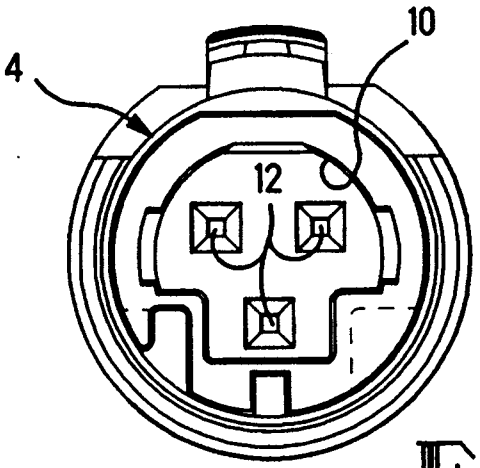
FIG. 4 is a front plan view of the connector shown in FIG. 1.

With reference first to FIG. 1, an electrical connector housing is shown generally at 2 including a front mating end 4, a rear terminal receiving end 6 and an intermediate sealing section, shown at 8. As shown best in FIG. 4, the front mating portion 4 includes an internal cavity 10 profiled for polarized interconnection with a mating connector. The mating portion 4 further comprises openings at 12 for receiving a pin terminal of a mating connector. The rear terminal receiving portion 6 includes a rear cavity at 14 for receiving the terminals and 3 discrete passageways 16*a–c* for discrete terminals.

Figure 3:
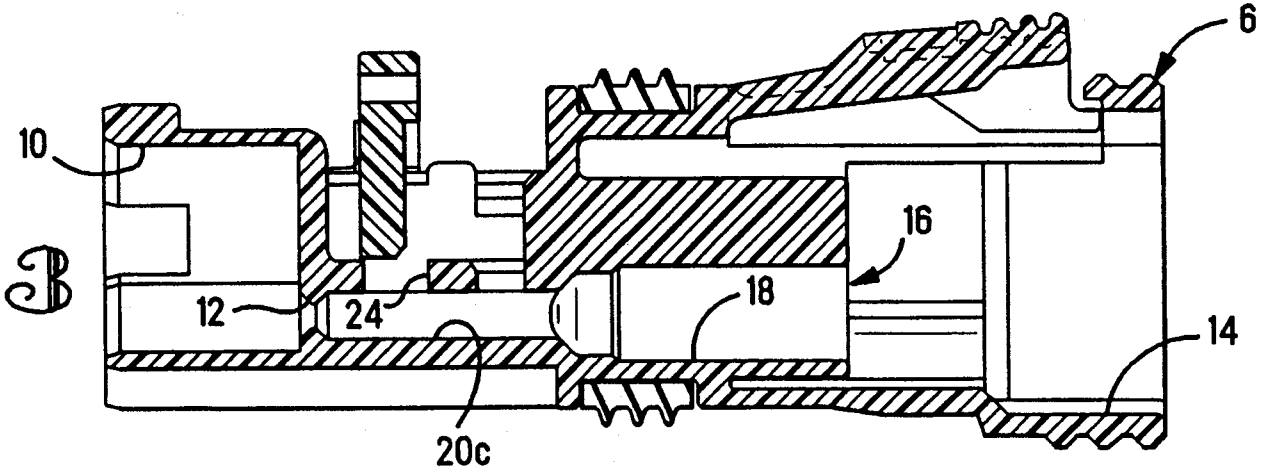
FIG. 3 is a cross-sectional view taken through lines 3—3 of FIG. 1.
Figure 5:
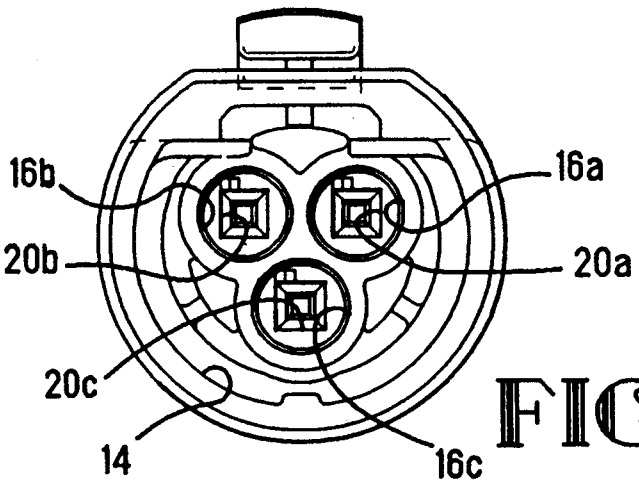
FIG. 5 is a rear plan view of the connector shown in FIG. 1.
Figure 7:
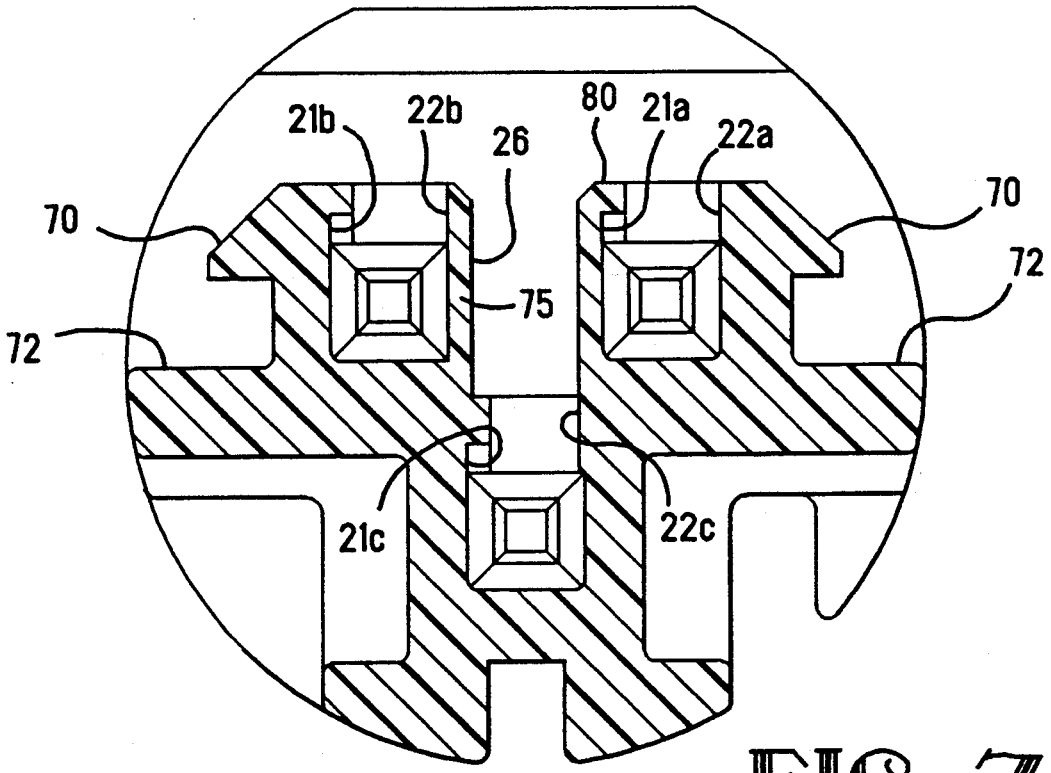
FIG. 7 is a cross-sectional view taken at the same position as FIG. 2 less the retention member.

As best shown in FIG. 3, the passageways 16*a–c* are comprised of a cylindrical portion shown at 18 for the receipt of a discrete wire seal and three generally square passageways at 20*a–c* for receiving electrical terminals similar to those shown in the previously mentioned European Patent Application. As shown best in FIG. 10, aperture 22*a* is directly above and intersects with passageway 20*a*, aperture 22*b* is directly above and intersects with passageway 20*b* and passageway 22*c* is above and intersects with passageway 20*c*. This is also shown in FIG. 7. Each of these apertures forms a rear locking shoulder, for example at 24 in FIG. 3, for a locking lance on the socket terminal as should be appreciated.

Figure 6:
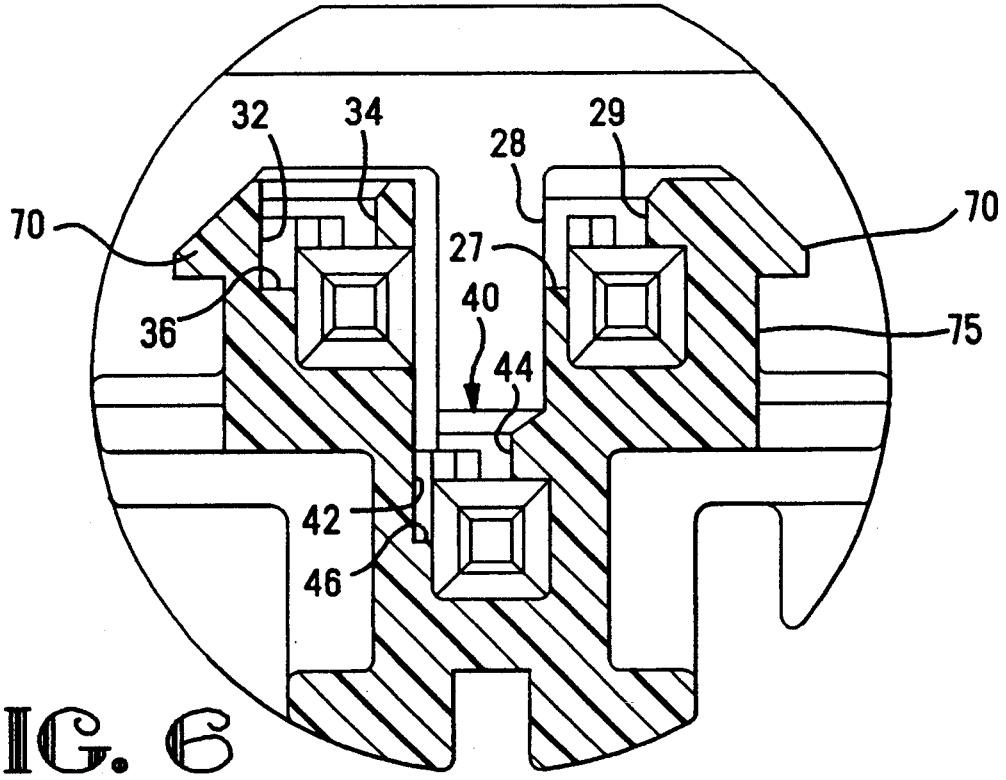
FIG. 6 is a cross-sectional view similar in nature to the cross-sectional view of FIG. 11 without the retention member.
Figure 10:
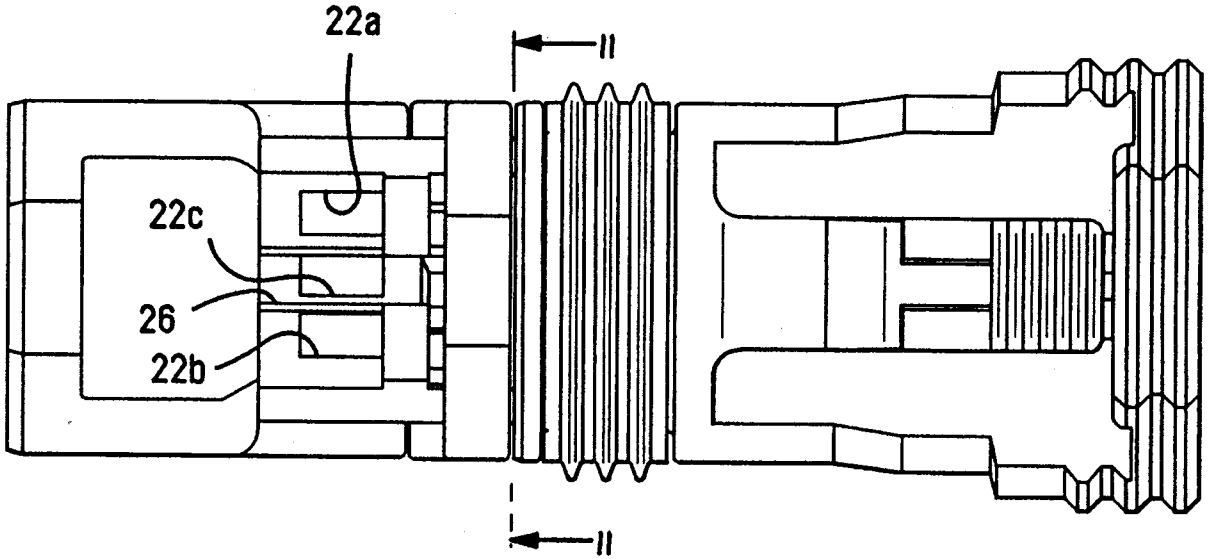
FIG. 10 is a top plan view similar to that of FIG. 1 showing the sliding lock member in the fully locked position.

In addition to the apertures 22*a–c*, the housing includes an elongate channel at 26 as best shown in FIGS. 7 and 10 which will be described in greater detail herein. Each passageway 16*a–c* also includes a corresponding polarizing slot for an upstanding wall of the electrical terminal, for example as shown in FIG. 7 at 21*a–*21*c*. As shown best in FIGS. 1 and 6, passageways are positioned above and centered with the upstanding slots 21*a–*21*c* for secondary locking purposes. The passageway 25 (FIG. 1) is defined by bottom surface 27, side wall 28 of the channel 26 and side wall 29 as best shown in FIG. 6. Aperture 30 is defined by side walls 32 and 34 and bottom surface 36. As shown in FIGS. 1 and 6, opening 40 is defined by side walls 42, 44 and a lower surface 46.

Figure 2:
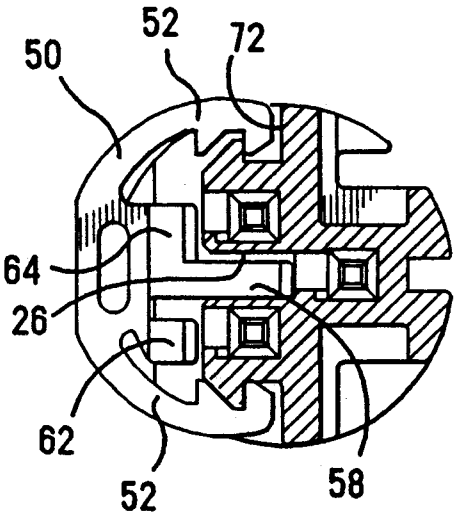
FIG. 2 is a cross-sectional view through lines 2—2 of FIG. 1.
Figure 9:
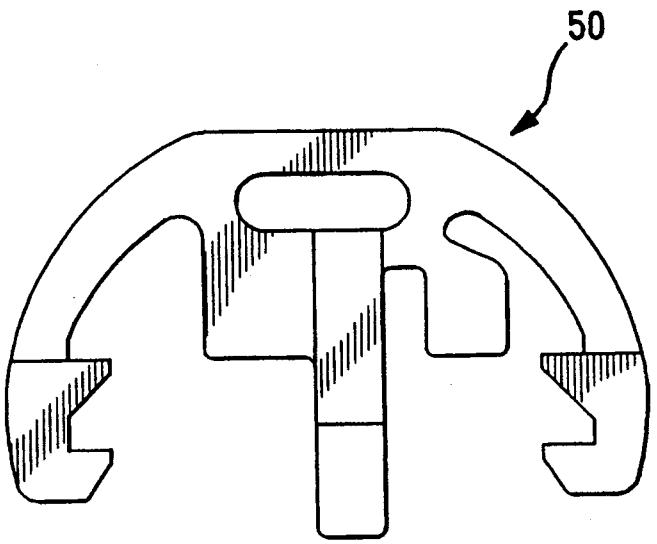
FIG. 9 is a front plan view of the sliding secondary lock member shown in FIG. 8.
Figure 8:
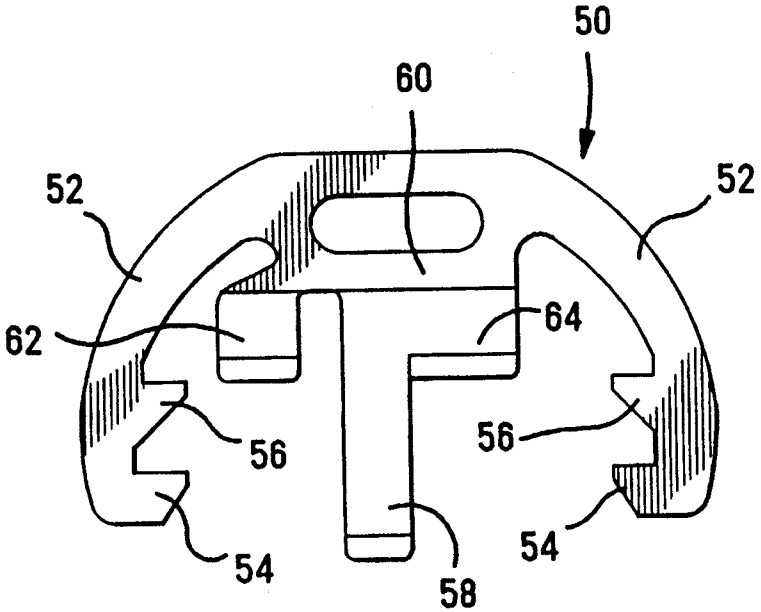
FIG. 8 is a rear plan view of the slidable locking member of the present invention.

With reference now to FIG. 2, the secondary lock member is shown generally at 50 and will be described in greater detail with reference to FIGS. 8 and 9. As shown in FIG. 8, and 9 the secondary lock member includes two latching straps at 52, each of which contain first latches 54 and second latches 56. With reference still to FIG. 8, a centrally located latching tongue 58 extends downwardly from a central section 60 of the latch member 50 and is asymmetrically located relative to the vertical axis, leftwardly justified as viewed in FIG. 8. The latch member 50 further comprises secondary latch members 62 and 64 extending downwardly from the central base portion 60.

Figure 11:
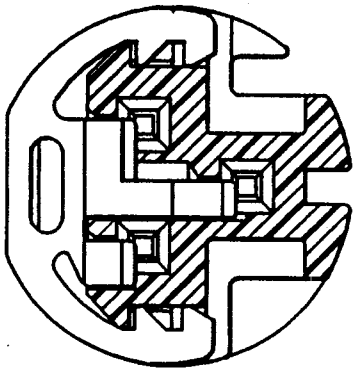
FIG. 11 is a cross-sectional view through lines 11—11 showing the fully locked position of the locking member.

As shown in FIG. 1, the secondary latching element 50 is shown in its prelocked position with the first latch elements 54 snapped over the side rails 70 (FIGS. 6 and 7) and latched to the connector housing 2. As shown in FIG. 7, below each of the latching rails 70 is an extension bar or stop at 72 which prevents the full insertion of the latch member 50 when in this position, as the latch straps 52 would abut the surfaces 72 upon further assembly. It should be appreciated however from FIGS. 2 and 3, that the center locking member 58 is positioned in the central channel 26, that when in a preassembled position, the latch member 50 is right justified as viewed in FIG. 2 relative to its final position, as shown in FIG. 11. This is to rigidify cavity 20*b* by use of a web of material at 75 as shown in FIG. 7. In other words if the wall 42 (FIG. 6) extended towards the front of the connector, the wall 42 would interfere with the inner part of cavity 20*b*. Rather, as the slot 26 extends towards the rear of the connector, as best shown in FIG. 1, surface 42 jogs to the left relative to the channel 26.

Also as shown in FIG. 2, each of the latching members 62 and 64 are positioned above the top surface 80 (FIG. 7) of the central section of the connector housing to prevent interference 64 therewith. It should also be appreciated from FIG. 1, that the stop shoulders 72 do not extend completely past the openings 25, 30, and 40, but rather stop in front of these openings to form a receiving channel, for example at 82, as best shown in FIG. 1 to receive the latching element 56 therethrough. When the latch element 50 is moved from its upper position as shown in FIG. 2 to its fully locked position, as shown in FIG. 11, the locking member 50 moves leftwardly to its final position between surfaces 42 and 44 (FIG. 6). As best seen in FIG. 1, ramp surfaces 73 extend from inner surfaces 75 (FIG. 6) which helps to align the locking member 50 laterally, when the member 50 overlies the receiving channel 82, but prior to the fully assembled position. This positions the locking member 58 in an overlapping relation with the slot 21*c* (FIG. 7), which also means that it overlaps with the upstanding sidewall on the electrical contact, providing good secondary locking engagement. The same is true of locking members 62 and 64, items 62 being positioned between sidewalls 32 and 34 and locking member 64 being positioned against side wall 29 (FIG. 6). Advantageously then, the secondary lock member 50 can be preassembled to the electrical connector body 2 as shown in FIG. 1 or 3 and is prevented from being pressed into its locking position by way of the lower stop surfaces 72 below the locking member. This prevents any snagging of wires forming the electrical harness with the locking member 50 prior to the fully assembled position.

We claim:

1. In an electrical connector comprising an insulating housing body and at least one passageway for receiving an electrical terminal, and a locking member for positively retaining said terminal in said one passageway, said housing body having at least one transverse channel in communication with said one passageway where said locking member is moveable transversely of said terminal into said one transverse channel where said locking member can be positioned behind a locking shoulder of said terminal, said connector being characterized in that said locking member is captively supported by said housing body, and said locking member is moveable longitudinally of said housing body from a first position where said terminal can be inserted, to a second position where said locking member is in alignment with said transverse passageway, said locking member being movable transversely into said transverse channel to a locked position to retain said terminal.

2. The electrical connector of claim 1, characterized in that said housing body has longitudinally extending rails along the sides thereof, and said locking member has latches which grip said rails for captive movement of said locking member longitudinally along said housing body.

3. The electrical connector of claim 2, characterized in that said housing body includes an extension bar beneath said rails, preventing transverse movement of said locking member, and said extension bar having an opening adjacent said transverse channel allowing transverse movement of said locking member.

4. The electrical connector of claim 1, characterized in that said locking member has two pairs of latching shoulders, a first pair allowing said first position, and said second pair allowing said locked position.

5. The electrical connector of claim 1, characterized in that said housing body has at least three passageways, two passageways in an upper row, and a third lower passageway intermediate said two upper passageways, said locking member comprising an elongate locking member extending between said two upper passageways, and two locking members positioned above said two upper passageways.

6. The electrical connector of claim 5, characterized in that said housing body includes an elongate channel intermediate said two upper passageways, for receiving said elongate locking member and allowing longitudinal movement of said locking member when in the prelocked position.

7. The electrical connector of claim 6, characterized in that said transverse passageway is laterally staggered from said elongate channel, said locking member being laterally shifted upon moving into said finally locked position.

8. An electrical connector comprising an insulating housing body and at least one passageway for receiving an electrical terminal, and a locking member for positively retaining said terminal in said one passageway, said housing body having at least one transverse channel in communication with said one passageway where said locking member is moveable transversely of said terminal into said one transverse channel where said locking member can be positioned behind a locking shoulder of said terminal, said connector being characterized in that said locking member is captively supported by said housing body, said housing body having longitudinally extending rails along the sides thereof, and said locking member having latching shoulders which grip said rails for captive movement of said locking member longitudinally along said housing body from a first position where said terminal can be inserted, to a second position where said locking member is in alignment with said transverse passageway for locking said terminal, said locking member being movable transversely into said transverse channel into a locked position to retain said terminal.

9. The electrical connector of claim 8, characterized in that said housing body includes an extension bar beneath said rails, preventing transverse movement of said locking member, and said extension bar having an opening adjacent said transverse channel allowing transverse movement of said locking member.

10. The electrical connector of claim 8, characterized in that said locking member has two pairs of latching shoulders, a first pair allowing said first position, and said second pair allowing said locked position.

11. The electrical connector of claim 8, characterized in that said housing body has at least three passageways, two passageways in an upper row, and a third lower passageway intermediate said two upper passageways, said locking member comprising an elongate locking member extending between said two upper passageways, and two locking members positioned above said two upper passageways.

12. The electrical connector of claim 11, characterized in that said housing body includes an elongate channel intermediate said two upper passageways, for receiving said elongate locking member and allowing longitudinal movement of said locking member when in the prelocked position.

13. The electrical connector of claim 12, characterized in that said transverse passageway is laterally staggered from said elongate channel, said locking member being laterally shifted upon moving into said finally locked position.

* * * * *